United States Patent [19]

Robinson et al.

[11] Patent Number: 4,476,821

[45] Date of Patent: Oct. 16, 1984

[54] ENGINE

[76] Inventors: Thomas C. Robinson, 100 Hill Rd., Berkeley, Calif. 94708; Sotiris Kitrilakis, 33 Roble Rd., Berkeley, Calif. 94705

[21] Appl. No.: 449,860

[22] Filed: Dec. 15, 1982

[51] Int. Cl.[3] ..... F02B 33/00

[52] U.S. Cl. ..... 123/68; 123/39; 123/275

[58] Field of Search ..... 123/68, 39, 261, 262, 123/275, 286, 287, 257, 280

[56] References Cited

U.S. PATENT DOCUMENTS

| | | | |
|---|---|---|---|
| 1,769,675 | 7/1930 | Bruckner | 123/275 |
| 1,902,776 | 3/1933 | Hesselman | 123/275 |
| 1,954,082 | 4/1934 | Lang | 123/275 |
| 3,443,552 | 5/1969 | Von Seggern et al. | 123/275 |
| 4,333,424 | 6/1982 | McFee | 123/68 |

*Primary Examiner*—Wendell E. Burns

*Attorney, Agent, or Firm*—Lothrop & West

[57] ABSTRACT

An engine has preferably coupled together a reciprocating air compressor discharging through a heat exchanger into a reciprocating cylinder piston combination, the flow into the piston cylinder combination being controlled by a cam-actuated inlet valve which is maintained open for a substantial fraction of the out-stroke of the combustion piston. There is also an exhaust valve from the combustion chamber which releases exhaust gas to the heat exchanger for transfer of thermal energy to the incoming compressed air. A fuel injector supplies fuel to the compressed air entering through the inlet valve into the combustion chamber over a large part of the out-stroke of the power piston.

8 Claims, 4 Drawing Figures

ENGINE

BRIEF SUMMARY OF THE INVENTION

An air compressor piston and cylinder combination in an engine is coupled to a crankshaft also coupled to a power piston and power cylinder combination. Various valves, operating in time with the crankshaft, admit air to the compressor cylinder and release compressed air from that cylinder to flow through a heat exchanger and through a then-open inlet valve into the power cylinder. The power cylinder inlet valve mechanism remains open for a substantial fraction of the outstroke of the power piston. During compressed air flow into the power cylinder through the open inlet valve, fuel is admixed with the compressed air in the vicinity of the inlet valve and in an amount for combustion. During the subsequent in-stroke of the power piston, the inlet valve is closed and the exhaust valve of the power cylinder is open to discharge the products of combustion from the power cylinder and through the heat exchanger to release exhaust heat to the compressed air in the heat exchanger. Exhaust gas flows from the heat exchanger to the atmosphere.

PRIOR ART

The applicants are presently unaware of prior art particularly pertinent to the claimed subject matter herein.

DETAILED DESCRIPTION

The internal combustion engine is arranged to combine compressed air and a fuel, such as an injectible liquid, and to make the arrangement such that the thermal efficiency of the overall combination is advantageous.

Figure 1:
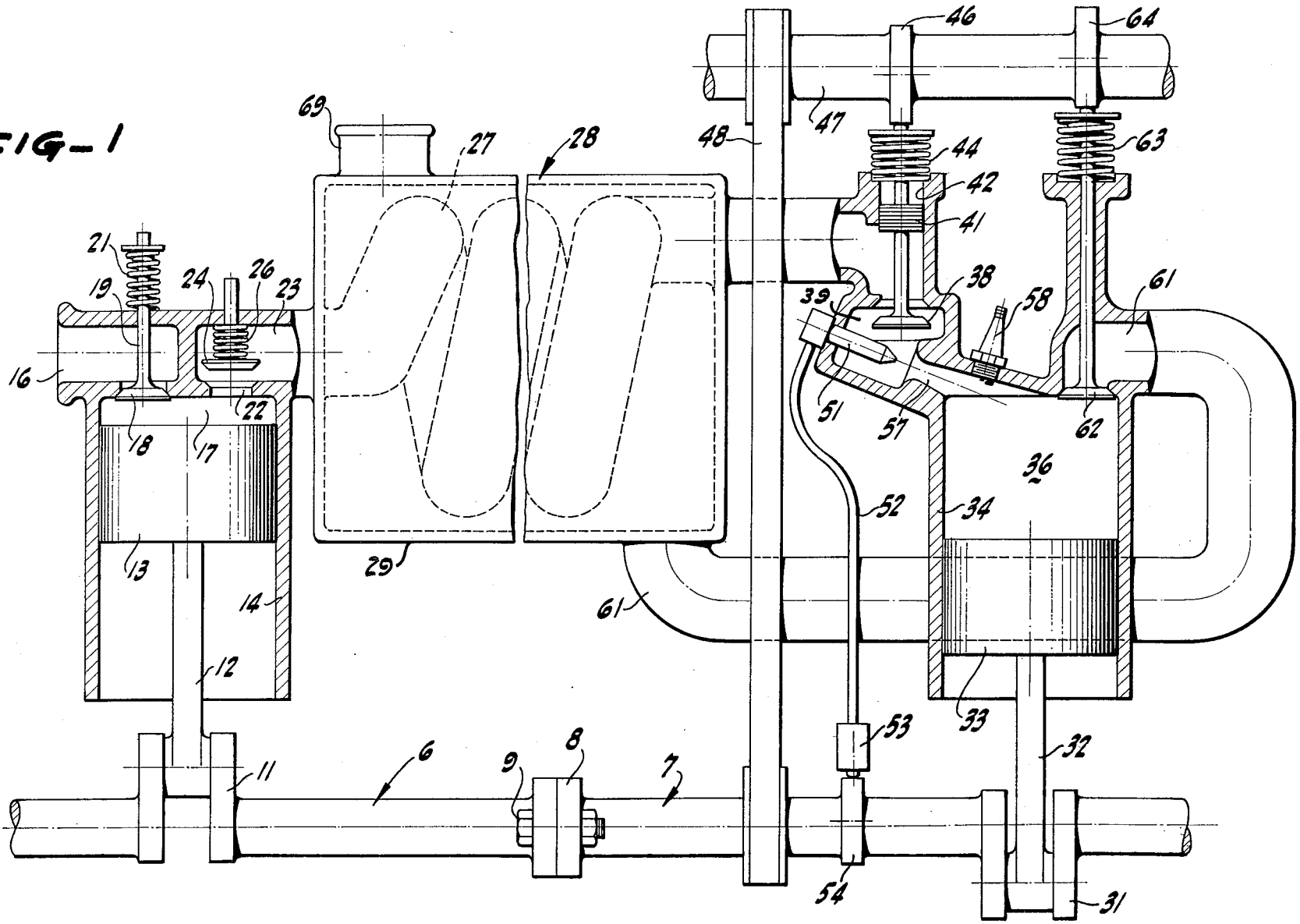
FIG. 1 is a diagrammatic showing of the engine of the invention, particularly illustrating the compressor cylinder combination together with the power cylinder combination, the intervening heat exchanger and the valving.

While the engine can be embodied in a large number of different forms, it is now preferably arranged as shown especially in FIG. 1. A first crankshaft portion 6 is joined to a second crankshaft portion 7 by a coupler 8 arranged to be coupled or released by the positioning or removal of fasteners 9. This is so that the crankshaft portion 6 can be driven by the crankshaft portion 7 or can be separately or otherwise driven. The crankshaft portion 6 has a throw 11 with the customary bearings and engaging one end of a connecting rod 12 extending to the usual connection to a piston 13 reciprocable within a cylinder 14. The piston 13 is shown about one quarter of the way to go to the top of its in-stroke.

The cylinder 14 has an atmospheric air inlet 16 opening to a compression chamber 17 within the cylinder above the piston. Flow through the inlet is controlled unidirectionally by a poppet valve 18 adapted to seat in the cylinder head and having a stem 19 interacting with a coil spring 21. The valve 18 is opened by pressure differential in one inflow direction and is similarly closed by pressure differential in the other outflow direction.

The chamber 17 opens through a port 22 into a duct 23, flow being controlled by a poppet valve 24 responsive to differential pressure and under the influence of a closing spring 26. As the piston 13 reciprocates outwardly, air is drawn in through the inlet 16 and the open valve 18 into the chamber 17. At this time the valve 24 is closed. Upon completion of the inlet stroke and movement of the piston 13 in the opposite, inward direction, the valve 18 closes, preventing egress from the cylinder through the duct 16, but the differential pressure overcomes the spring 26 and opens the valve 24 so that the compressed air flows from the chamber 17 into the duct 23. Further, travel is through a coil 27 or other suitable heat exchange surface forming part of a heat exchanger 28 enclosed by a jacket 29 encompassing the coil 27.

The crankshaft portion 7 is likewise provided with a throw 31 usually set diametrically opposite the throw 11. The throw 31 carries a connecting rod 32 joined to a piston 33 reciprocable within a power cylinder 34 in the customary fashion. The piston 33 is shown as having gone about three quarters of its stroke away from the top point of its travel. There is thus provided a variable volume clearance chamber 36 within the cylinder 34. As the crankshaft revolves, compressed air flowing through the duct 27 is able, in timed relationship, to flow past an open valve 38 into an antechamber 39 open to the chamber 36.

The valve 38 is preferably arranged so that it has a trunk 41 reciprocable within a cylinder 42 so that pressures on the valve head and on the trunk portion are substantially balanced to reduce the work of moving the valve. There is a spring 44 assisting in the motion of the valve in one direction. The amount and timing of the valve motion are controlled by a cam 46 on a cam shaft 47 having a coupling 48 to the crankshaft portion 7 so as to run in time therewith. The arrangement is such that about as the piston 33 is starting on its out-stroke with a minimum volume combustion chamber 36, the valve 38 opens to permit compressed air from the duct 27 to flow toward the cylinder past the valve 38 and into the antechamber 39.

At that time there is a fuel charge added to the inflowing compressed air. This is accomplished by an injector 51 projecting generally axially into the antechamber. A fuel inlet duct 52 connected to a timed pump 53 controlled by a cam 54 on the crankshaft portion 7 supplies fuel to the injector 51. Preferably, the fuel jetted from the injector 51 travels into the antechamber 39 and then through a tube or venturi-shaped communicating passage 57 into the clearance chamber 36.

In many instances, depending upon the fuel used and the fuel-air mixture, combustion immediately ensues upon injection with expansion into the clearance chamber 36. In some instances, it is desired to initiate or augment the ignition of the fuel. An ignition device 58 or sparkplug is therefore positioned so as to aid in igniting the incoming combustible air-fuel mixture.

The clearance chamber 36 is also connected to an exhaust duct 61, out-flow being regulated by a poppet valve 62 having a spring 63 and actuated by a cam 64 on the cam shaft 47. The exhaust valve 62 operates in time with the remaining part of the mechanism. It is normally closed during combustion and the out-stroke of the piston 33 and is opened to release burned gases into the duct 61 as the piston 33 engages in its in-stroke. Flow of the hot gases through the duct 61 is into the jacket 29 of the heat exchanger 28. Much of the exhaust gas heat is released to the compressed air flowing toward the combustion cylinder, and then the cooled exhaust gas discharges through a pipe 69 to the atmosphere.

It is to be noted particularly that during the operation of the piston 33 the inlet valve 38 remains open from approximately a top dead center position or in dead center position of the piston 33 for a large part of the out-stroke of that piston and that combustion occurs over a protracted period relative to the out-stroke of the piston 33. The piston 33 does not serve to compress gas except possibly during an exhaust stroke, but the combustion air is already compressed by the compressor and so enters into the combustion chamber at a relatively high value or pressure. The cycle of the engine is not the customary Otto cycle, but is more nearly akin to the Brayton cycle.

Since the air compression is conducted separately and since the exhaust gas from the power chamber is utilized to transfer heat to the incoming compressed air, and since the combustion takes place over a long or large part of the power stroke of the piston 33, the thermal efficiency of the engine is improved.

Figure 2:
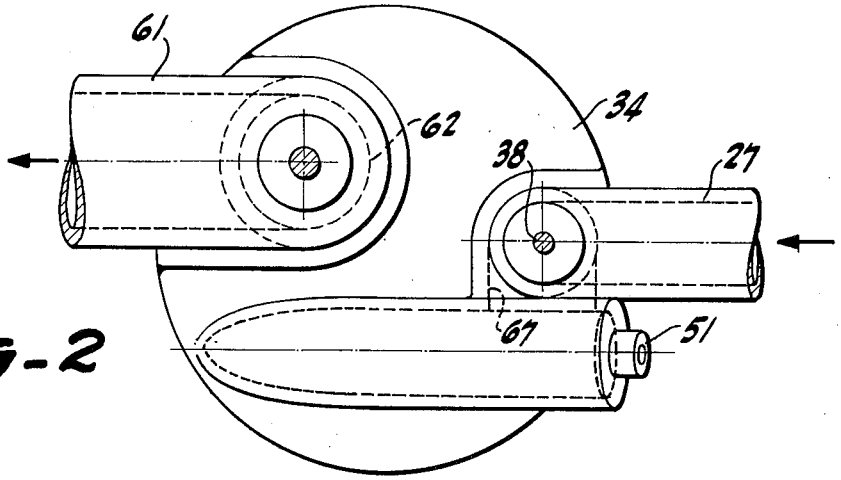
FIG. 2 is a diagrammatic plan of a portion of the power cylinder mechanism.
Figure 3:
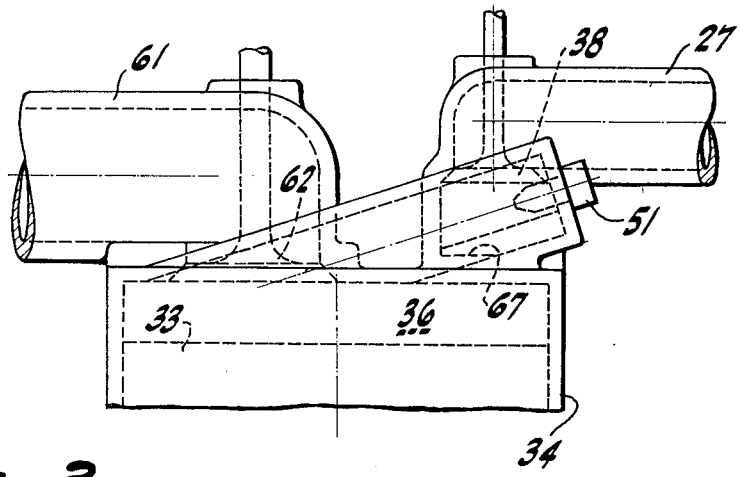
FIG. 3 is a side elevation of the structure of FIG. 2.

As especially shown in FIGS. 2 and 3, it is preferred that the duct 27 where it enters into the combustion chamber communicate by a generally tangential passage 67 with the antechamber 39 in the vicinity of the tube 57, so that the inflowing gases have some tangential swirl as they mix with the injected fuel.

Figure 4:
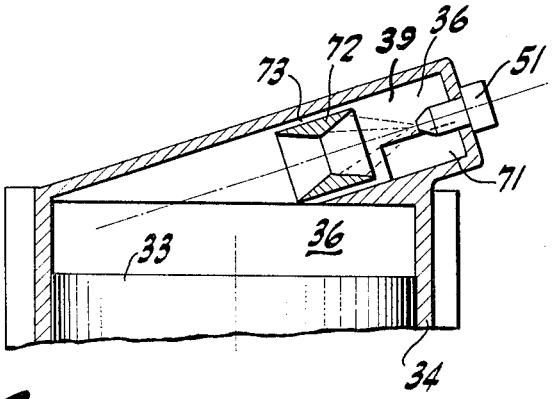
FIG. 4 is a modification showing a special arrangement of the fuel entry portion of the power cylinder.

A further variation as shown in FIG. 4 has the same tangential passageway 71 into the combustion chamber 36 but preferably has a venturi unit 72 arranged coaxially in the precombustion chamber 39, so that air coming in through the tangential opening 71 swirls around not only the outside of the venturi section 72; that is, between that venturi section and the combustion chamber wall, in a resulting annular passage 73, but also flows through the generally venturi-shaped member itself. The fuel injector 74 injects the fuel axially so that there is a good fuel-air mixture as the air and fuel are on their way into the combustion chamber.

We claim:

1. An engine comprising a cylinder having a head, a piston reciprocable within said cylinder toward and away from said head, means defining an antechamber in said head and spaced from said cylinder, a source of compressed air, means for conducting compressed air from said source to said antechamber, a timed inlet valve opening into said antechamber for controlling flow of said compressed air through said conducting means into said antechamber, a duct having an axis and opening at one end to said antechamber and at the other end opening into said cylinder, an injector in said antechamber and effective while said inlet valve is open for injecting fuel along said axis into said tube in an axial direction, a heat exchanger in heat exchange relationship with said compressed air conducting means, means for carrying exhaust gas from said cylinder to said heat exchange means, and a timed exhaust valve controlling flow of exhaust gas through said carrying means from said cylinder to said heat exchanger.

2. A device as in claim 1 including electrical means in said tube for igniting said fuel and air therefrom.

3. A device as in claim 1 in which said fuel adding means is an injector in said antechamber and discharging along said axis and through said tube into said cylinder.

4. A device as in claim 1 in which said cylinder at one end merges with said antechamber through a venturi tube having a throat, and said fuel adding means is an injector in said antechamber discharging toward and into said venturi throat.

5. An engine comprising a cylinder having a cylinder axis, an antechamber spaced from said cylinder, a tube extending along a tube axis inclined to said cylinder axis and connecting said antechamber and said cylinder, a piston reciprocable within said cylinder toward and away from top dead center position, a crankshaft connected to said piston, a source of compressed air, an air duct for conducting compressed air from said source to said antechamber, an inlet poppet valve between said air duct and said antechamber for controlling flow of said compressed air through said air duct, means operating in time with said crankshaft for opening said inlet poppet valve into said antechamber at least part of the time said piston travels away from said top dead center position, an injector discharging substantially axially into said tube toward said cylinder and effective while said inlet poppet valve is open for adding fuel to said compressed air flowing from said antechamber through said tube toward and into said cylinder, an exhaust valve controlling flow of gas from said cylinder, and means operating in time with said crankshaft for opening said exhaust valve at least part of the time said piston travels toward said top dead center position.

6. An engine as in claim 5 in which said fuel adding means is an injector discharging axially into said tube in the direction of air flowing through said tube and transversely offset from the cylinder axis.

7. An engine as in claim 5 in which said cylinder has a cylinder head defining a clearance chamber substantially symmetrical about an axis, said fuel adding means supplies fuel to said clearance chamber along said axis, and a tubular sleeve is disposed in said clearance chamber along said axis in the path of said supplied fuel and spaced from the wall of said clearance chamber.

8. An engine comprising a cylinder having a cylinder head defining an antechamber spaced from and open to said cylinder through an elongated tube, means defining a port in said antechamber, a piston reciprocable in said cylinder, a crankshaft, means for connecting said piston and said crankshaft, means for supplying air to said antechamber through said port, a poppet valve for opening and closing said port by movement into and away from said antechamber, means for operating said poppet valve in time with said crankshaft to move said poppet valve into said antechamber to open said port from a time when said piston is substantially at top dead center position until a time after said top dead center position when said piston is in a position a substantial distance away from said top dead center position, and means for injecting fuel into said antechamber and along the length of said tube toward said cylinder while said port is open.

* * * * *